US009250018B2

(12) United States Patent
Cain

(10) Patent No.: US 9,250,018 B2
(45) Date of Patent: Feb. 2, 2016

(54) APPARATUS AND METHODS FOR ACHIEVING LOW $NO_x$ IN A GRATE-KILN PELLETIZING FURNACE

(75) Inventor: Bruce E. Cain, Akron, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 735 days.

(21) Appl. No.: 12/732,440

(22) Filed: Mar. 26, 2010

(65) Prior Publication Data

US 2011/0109021 A1 May 12, 2011

Related U.S. Application Data

(60) Provisional application No. 61/258,831, filed on Nov. 6, 2009.

(51) Int. Cl.
*F27B 7/38* (2006.01)
*F27B 7/20* (2006.01)
*C22B 1/24* (2006.01)

(52) U.S. Cl.
CPC ..... *F27B 7/2016* (2013.01); *C22B 1/2406* (2013.01); *F27B 7/38* (2013.01)

(58) Field of Classification Search
CPC ..... C22B 1/2406; F27B 7/2016; F27B 7/38
USPC ..... 266/44, 87, 213; 432/14, 103, 105, 106, 432/11
See application file for complete search history.

(56) References Cited

U.S. PATENT DOCUMENTS 3,091,442 A 5/1963 Romig et al.
3,172,754 A 3/1965 Anthes et al.
3,313,534 A 4/1967 Frans
3,332,770 A * 7/1967 Wendt, Jr. et al. ..... 75/484
3,584,850 A * 6/1971 Brandvold et al. ..... 106/753
3,947,001 A 3/1976 Leighton
3,986,819 A * 10/1976 Heian ..... 432/14
4,236,887 A * 12/1980 Heian ..... 432/14
4,313,757 A 2/1982 Kiyonoga
4,353,750 A 10/1982 Quittkat
4,367,065 A * 1/1983 Cnare ..... 432/14
4,503,018 A 3/1985 Gardner et al.
4,533,396 A * 8/1985 Herchenbach et al. ..... 106/758
4,689,007 A 8/1987 Kilian
5,057,009 A * 10/1991 Nechvatal et al. ..... 432/14
5,630,864 A 5/1997 Rierson
5,730,591 A 3/1998 Robertson et al.
6,116,896 A 9/2000 Joshi et al.

(Continued)

OTHER PUBLICATIONS

PCT/US2010/051745, Patent Cooperation Treaty, Notification of Transmittal of the International Search Report and the Written Opinion of the International Search Authority, dated Dec. 2, 2010, 19 pages.

(Continued)

*Primary Examiner* — Roy King
*Assistant Examiner* — Michael Aboagye
(74) *Attorney, Agent, or Firm* — Benesch, Friedlander, Coplan & Aronoff, LLP

(57) ABSTRACT

A grate-kiln pelletizing furnace includes a grate that conveys pelletized material to a rotary kiln, a cooler that cools pelletized material from the rotary kiln, and a gas flow apparatus that directs a stream of gas from the cooler to the rotary kiln to provide preheated process air for pelletized material in the rotary kiln. The gas flow apparatus also directs a stream of gas from the grate to the rotary kiln to vitiate the preheated process air.

6 Claims, 11 Drawing Sheets

(56) References Cited

U.S. PATENT DOCUMENTS

| | | | | |
|---|---|---|---|---|
| 6,183,242 | B1 * | 2/2001 | Heian | 432/11 |
| 6,221,127 | B1 | 4/2001 | Rierson | |
| 6,421,931 | B1 | 7/2002 | Chapman | |
| 6,685,117 | B2 * | 2/2004 | Poeschl | 241/48 |
| 6,855,302 | B2 | 2/2005 | Eckert et al. | |
| 2002/0061489 | A1 * | 5/2002 | Gardner | 432/117 |

OTHER PUBLICATIONS

Specification and Drawings from Copending U.S. Appl. No. 12/552,518, filed Sep. 2, 2009, entitled, "NOx Suppression Techniques for a Rotary Kiln", 32 pages.

Specification and Drawings from Copending U.S. Appl. No. 12/552,515, filed Sep. 2, 2009, entitled, "NOx Suppression Techniques for an Indurating Furnace", 25 pages.

Reed, Richard J., North American Combustion Handbook—A Basic Reference on the Air and Science of Industrial Process Heating with Gaseous and Liquid Fuels, Volume I: Combustion, Fuels, Stoichiometry, Heat Transfer, Fluid Flow, pp. 200-205, Third Edition, Second Printing, 1986, North American Mfg. Co., Cleveland, Ohio.

Australian Patent Application No. 2010315731, Patent Examination Report No. 1 from the Australian Patent Office, dated Mar. 22, 2013.

* cited by examiner

APPARATUS AND METHODS FOR ACHIEVING LOW $NO_x$ IN A GRATE-KILN PELLETIZING FURNACE

TECHNICAL FIELD

This technology includes grates, rotary kilns, coolers, and other components of grate-kiln pelletizing furnaces.

BACKGROUND

The grate-kiln pelletizing process is a means of indurating iron ore into pellets suitable for transportation and subsequent use in blast-furnaces and steel-making. The iron ore fines are mixed with other materials such as dolomite and bentonite, and formed into round balls, which are then loaded onto a moving grate, where they are dried, preheated, and partially hardened. Final hardening takes place when the pellets are discharged from the grate into a large rotary kiln, where they are heated to 2400-2500 F by means of a large burner firing into a process air stream, with an excess of oxygen in the products of combustion. (In some cases oxidation of iron in the ore also provides heat input to the process.) The pellets are then cooled in a cooler by forcing a stream of ambient air through the pellets. The process air stream for the kiln is the hot air generated from cooling the pellets in the cooler combined with products of combustion from the kiln burner.

Since the heat transferred to the pellets in the grate and kiln sections is regenerated into the process air in the cooler, the process is very energy efficient, but the process requirement for large excess of oxygen in the kiln combined with the high air temperature in the air entering the kiln from the cooler also results in very high NOx. It would be valuable to be able to reduce the NOx generated by the kiln burner while still maintaining the high process efficiency by using the process air.

There are other similar processes that incorporate rotary kilns fired by a burner and supplied with a process air stream that has been pre-heated by cooling the product in a cooler. The invention is applicable to those processes as well.

Typical prior art grate-kiln pelletizing furnaces incorporate a large rotary kiln fired by one or two very high capacity (100 to 500 MMBtu/h) kiln burners which combust hydro-carbon fuels, usually natural gas, fuel oil, coal, or biomass, in an excess of high-temperature preheated air, to provide a high temperature (2400-2500 F) oxidizing environment which is needed to indurate iron ore pellets. The typical kiln is fired by a single large burner, with a very long high temperature flame. The large flame envelope results in a very large interface area between the flame and the high-temperature oxidant, and in long residence times. Thus, the large flame envelope, high preheat temperature, high flame temperature, and large excess of oxygen in the combustion zone all combine to generate very high NOx emissions.

The prior art design is very fuel efficient, in that the heat stored in the pellets is transferred to preheat air to temperatures as high as 2000 F; this air is then subsequently used for drying and heating the pellets, and as oxidant for the fuel needed to heat the process gases to the required temperature. The problem is that the factors that make the process fuel-efficient contribute strongly to the formation of NOx. Most of the strategies used by prior art low-NOx burners either do not work very well in the high temperature highly oxidizing environment, or have significant negative impacts on fuel efficiency.

The only other means available for NOx reduction have been after-treatment methods such as SCR, SNCR, and LO-TOX. These methods are either very expensive to implement, require significant additional energy input to the process, or are impractical to incorporate into the process.

In the context of maximizing fuel efficiency with unregulated emissions, the prior art arrangements make intuitive sense, as the highest temperature streams of recuperated cooling air are used in the highest temperature part of the process.

FIGS. 1, 2, and 3 show configurations typical of the prior art. In FIG. 1, hot indurated pellets are discharged from a kiln 10 into a cooler 12. A cooling air blower 14 blows a cooling air stream over the pellets in the cooler 12, cooling the pellets and heating the cooling air. The blower 14 is part of a gas flow apparatus that includes blowers, burners, ducts, flow control devices, controllers, and other known devices as needed, in a configuration that provides the heated process air and other reactants for the indurating process. The cooler 12 is typically segmented into stages or sections 20, with the cooling air leaving the sections 20 closest to the discharge end 22 of the kiln 10 hotter than the cooling air leaving the sections 20 farther from the discharge end 22 of the kiln 10. In the case of coolers in which the travel is rotational, such as annual coolers, the terms "closest" and "farther," as used above, refer to the distance that the pellets have travelled along the path of rotation of the cooler 12, as opposed to the linear distance from the discharge end of the kiln 10.

In FIG. 1, air at approx. 2000 F air leaving the hottest section 20 of the cooler 12 passes through a combination of hood and duct structures 24 before entering the kiln 10. A kiln burner 26 typically fires one or more fuels such as natural gas, fuel-oil, coal, biomass, etc. into the discharge end 22 of the kiln 10. The kiln burner 26 is typically provided with a stream of combustion air which is much less than the amount required to completely combust the air. The process air from the cooler 12 includes a large excess of air compared to what is required to burn the fuel, so there are typically oxygen levels from 10% to 16% in the process air leaving the kiln 10 after fully combusting all of the fuel.

The process gases leaving the kiln 10 pass through one or more ducts 30 to the final preheat section 34 of a traveling grate 36. Dried and partially hardened pellets discharge from the grate 36 into the kiln 10 where the indurating process is completed. The process gases at perhaps approximately 2400 F are induced by a process gas blower 38 to flow through the pellet bed on the grate 36, preheating the pellets; in doing so, the process gases are cooled to perhaps 600 F before entering the process gas blower 38. The process gas blower 38 then discharges the process gases through ducts 40 into the drying section 42 of the grate 36. The pellets at approximately ambient temperature enter the drying section 42 at the feed end 44 of the grate 36. In drying the pellets, the process gases are further cooled to a temperature typically between 200 and 400 F, before being discharged to atmosphere through an induced draft fan 46 and stack 48. It is typical for the exhaust to also be processed by means of equipment such as cyclone separators, electro-static precipitators, or baghouses (none of which are shown) to remove particulates before being discharged into the stack.

Typically, there are also one or more intermediate stages 50 of drying and/or preheat sections between the first drying section 42 and the final preheat section 34. In one typical configuration (FIG. 1), hot air at perhaps 1300 F from an intermediate section 20 of the cooler 12 is directed through a duct 51 and further heated by an air heater 52 to about 1500 F before being ducted to one of the intermediate sections 50 of the grate 36. The air heater 52 is fired by a burner 54 using a fuel (typically natural gas, propane, or fuel oil) to provide the heat necessary for raising the temperature of the hot air to the required level. The process gases from the air heater 52 are then drawn through one or more intermediate drying/preheat sections 50, sometimes in a combination of updraft and downdraft configurations (not shown), before being processed through gas clean-up equipment (not shown) as described earlier and then being exhausted to atmosphere.

A slightly different known configuration is shown in FIG. 2. The difference between FIG. 2 and FIG. 1 is that in FIG. 2, the process gas from the intermediate section 20 of the cooler 12 does not pass through the air heater 52. Instead, the air heater 52 incorporates a stream of dilution air from a dilution air blower 56 (or alternatively from a combined air heater combustion air and dilution air blower—this alternative not shown) to create a hot gas stream of perhaps 2000 F that mixes with the incoming air stream from the intermediate stage 20 of the cooler 12 to produce a combined process gas stream at 1500 F, with a higher total mass flow rate, which is then directed to the grate as in FIG. 1.

Another known configuration in the prior art is shown in FIG. 3. In FIG. 3, preheat burners 60 are installed in the roof or sides of the preheat and/or drying sections of the grate 36. The preheat burners 60 may be used instead of the air heater 52 shown in FIGS. 1 and 2 or in addition to the air heater 52.

In each prior art arrangement of FIGS. 1, 2, and 3, process air of approximately 800 F from the final (coolest) stages 20 of the cooler 12 may be directed through ducts 62 to other parts of the plant (such as for grinding), or may be exhausted to the atmosphere through a stack 64 at approximately 300 F. The elements that differ between the three prior art configurations are sometimes used in combination with each other, e.g. some configurations have both preheat burners 60 and an air heater 52.

SUMMARY OF THE INVENTION

The invention applies to a grate-kiln pelletizing furnace including a grate that conveys pelletized material to a rotary kiln, a cooler that cools pelletized material from the rotary kiln, and a gas flow apparatus that directs a stream of gas from the cooler to the rotary kiln to provide preheated process air for pelletized material in the rotary kiln. In a preferred embodiment of the invention, the gas flow apparatus also directs a stream of gas from the grate to the rotary kiln to vitiate the preheated process air.

Another embodiment of the invention includes a gas flow apparatus that directs a first stream of gas from the cooler to the rotary kiln to provide preheated process air for pelletized material in the rotary kiln, directs a second stream of gas from the cooler to the grate to transfer heat from pelletized material in the cooler to pelletized material on the grate. In accordance with the invention, the gas flow apparatus diverts a portion of the first stream to mix into the second stream.

In another embodiment of the invention, the gas flow apparatus a) draws successively cooler streams of gas from respective sections of the cooler, including a first stream from a first section and a second stream from a second section cooler than the first section, b) directs the first stream from the cooler to the grate to transfer heat from pelletized material in the cooler to pelletized material on the grate, and c) directs the second stream from the cooler to the rotary kiln to provide preheated process air for pelletized material in the rotary kiln.

In yet another embodiment of the invention, the rotary kiln has a burner, and the gas flow apparatus directs a stream of gas from the cooler to the burner to provide preheated combustion air to the burner. This embodiment preferably includes means for cleaning the stream of gas.

The invention also provides a method of operating an apparatus including a rotary kiln, a grate configured to convey pelletized material to the rotary kiln, and a cooler configured to cool pelletized material from the rotary kiln. The method may comprise the steps of directing a first stream of gas from the cooler to the rotary kiln to provide preheated process air for pelletized material in the rotary kiln, and directing a second stream of gas from the grate to the rotary kiln to vitiate the preheated process air.

The method may alternatively comprise the steps of directing a first stream of gas from the cooler to the rotary kiln to provide preheated process air for pelletized material in the rotary kiln; directing a second stream of gas from the cooler to the grate to transfer heat from pelletized material in the cooler to pelletized material on the grate; and diverting a portion of the first stream to mix into the second stream.

In another alternative, the method may comprise the steps of drawing successively cooler streams of gas from respective sections of the cooler, including a first stream from a first section and a second stream from a second section that is cooler than the first section; directing the first stream from the cooler to the grate to transfer heat from pelletized material in the cooler to pelletized material on the grate; and directing the second stream from the cooler to the rotary kiln to provide preheated process air for pelletized material in the rotary kiln.

Another method is provided for operating an apparatus including a rotary kiln, a burner configured to fire into the rotary kiln, and a cooler configured to cool pelletized material from the rotary kiln. This method comprises the step of directing a stream of gas from the cooler to the burner to provide preheated combustion air to the burner.

The invention further provides a method of retrofitting an apparatus that has a capacity to provide heat input to a grate as a fraction of a total heat input provided to the grate and a rotary kiln. The retrofitting method configures the apparatus to have an increased capacity to provide heat input to the grate as a fraction of the total heat input provided to the grate and the rotary kiln, whereby the retrofitted apparatus can provide an equally decreased fractional heat input at the rotary kiln to yield less NOx from the rotary kiln.

BRIEF DESCRIPTION OF THE DRAWINGS

Each of FIGS. 1-3 is a schematic view of parts of a respective prior art grate-kiln pelletizing furnace.

Each of FIGS. 4-11 is a schematic view of parts of a respective grate-kiln pelletizing furnace configured according to the invention.

DETAILED DESCRIPTION

A principal feature of the invention re-directs some of the process gas and recuperated air from the cooler to maintain efficiency or at least minimize efficiency losses, while firing the kiln with a lower average oxidant temperature, and to provide the kiln with oxidant that has been somewhat vitiated. This can lower NOx emissions while maintaining high process efficiency.

The invention may replace some or all of the ambient cooling air with exhaust gases leaving the drying or preheating stage as a first stage of cooling media in the cooler. This then becomes a source of vitiated high temperature oxidant for the kiln, which can further reduce the oxygen level in the kiln and reducing NOx.

Another principal feature of the invention re-routes some or all of the highest temperature air leaving the cooler to the grate preheating and/or drying sections, instead of directing it to the kiln. Lower temperature air can be provided to the kiln to replace the higher temperature air that was re-routed, for example by increasing the capacity of the combustion air blower providing air to the kiln burner. The reduced air temperature resulting from re-routing high temperature air from the cooler and replacing it with lower temperature air (for example, increased combustion air to the kiln burner) can reduce NOx. This reduced temperature air to the kiln additionally provides the benefit of allowing the kiln to be fired with a lean pre-mix or other Low NOx burner which further reduces NOx. Although redirecting part of the higher temperature air stream a longer distance (to the grate section instead of directly into the kiln), may in some cases result in a more expensive installation, it can allow the high process efficiency typical of the prior art configuration to be maintained. If the high temperature air were not re-directed, a choice might have to be made between high efficiency and low NOx, but the invention is expected to eliminate the need to choose—both high efficiency and low NOx can be realized in a grate-kiln indurating furnace environment.

Figure 1:
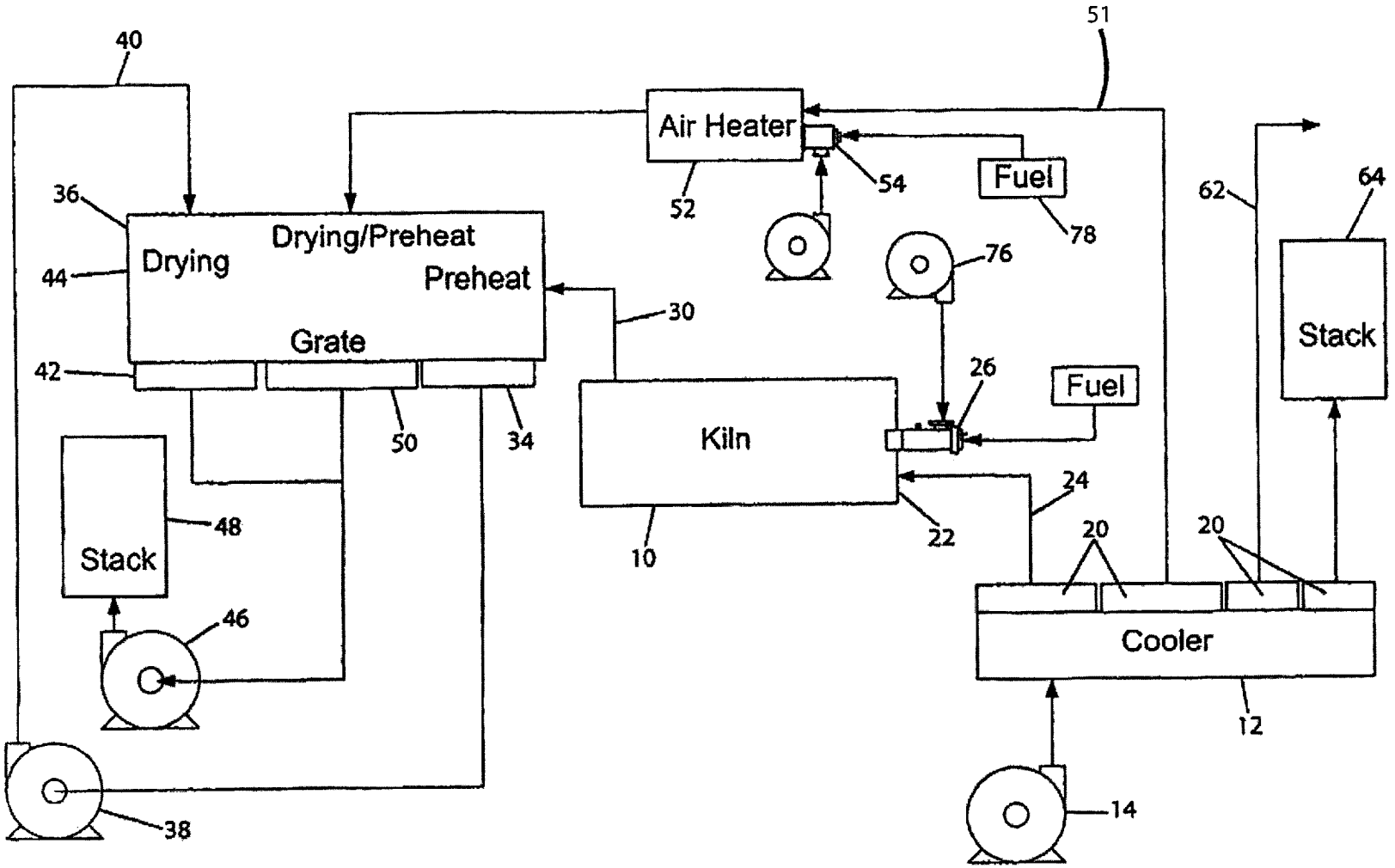
Fig. 1 Prior Art
Figure 3:
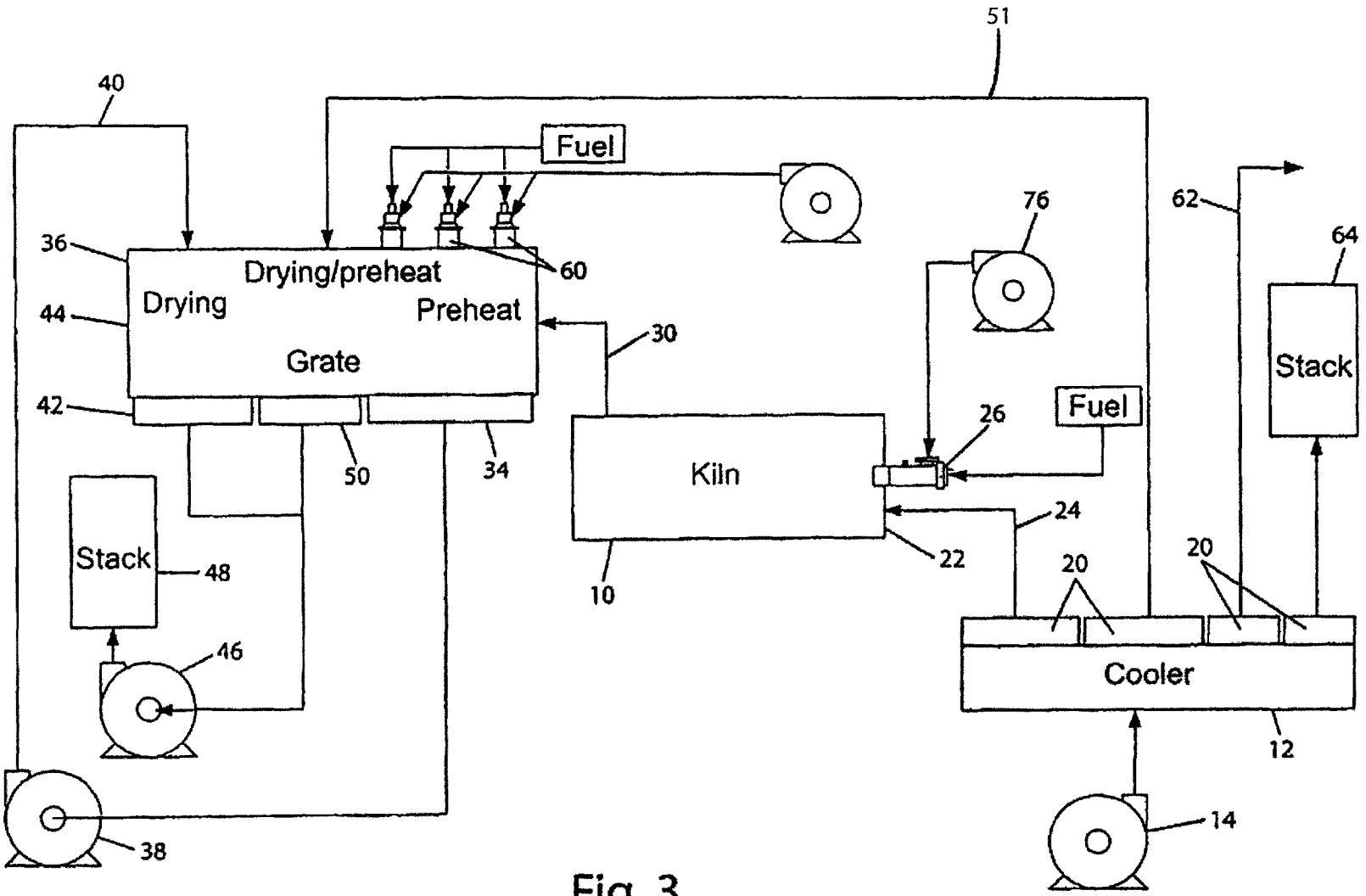
Fig. 3 Prior Art
Figure 4:
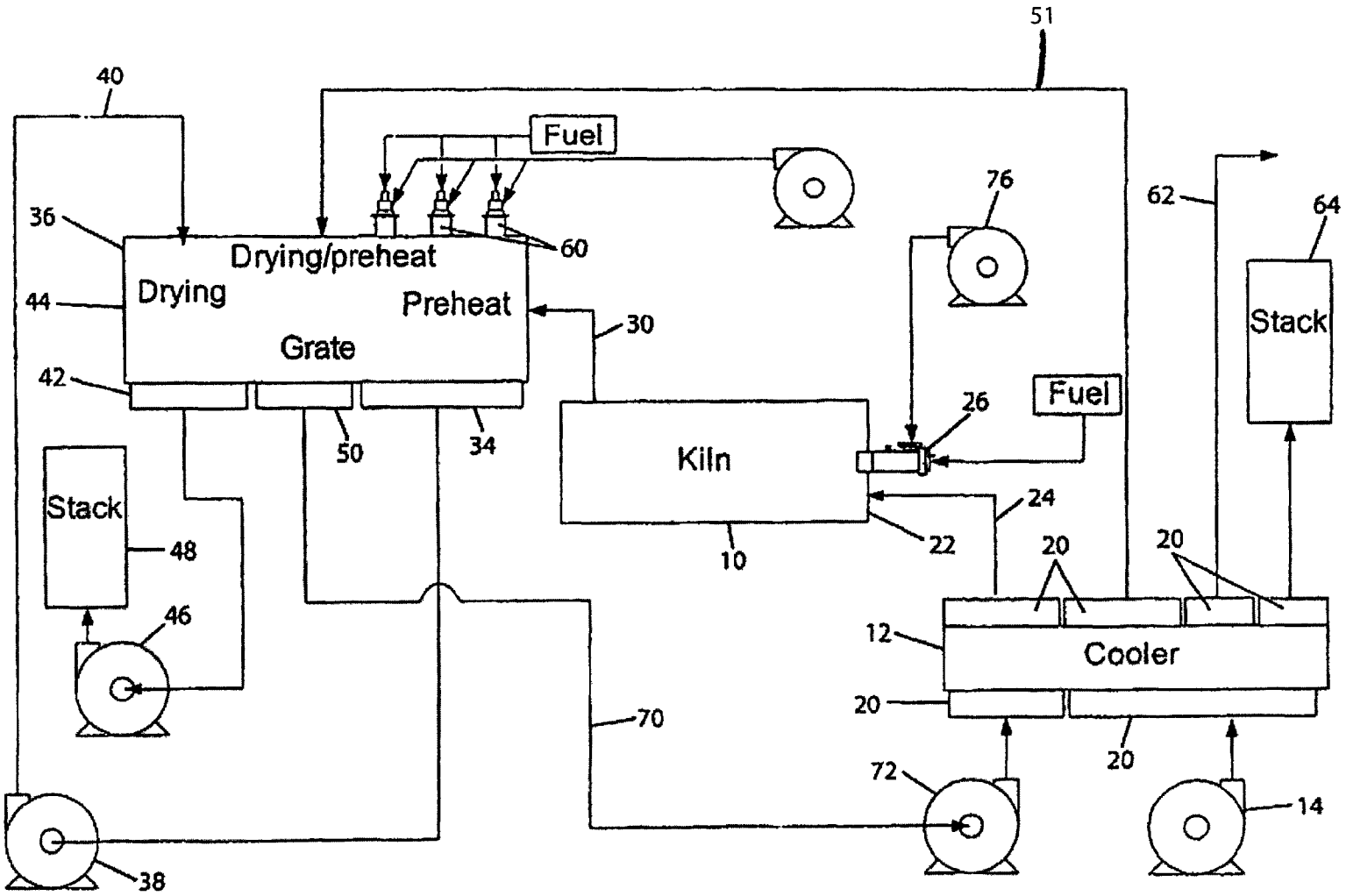

One embodiment of the invention is shown in FIG. 4. In this embodiment, the cooling media supplied to the first stage 20 of the cooler 12 has been changed. In the prior art of FIGS. 1-3, only ambient air is provided to the cooler 12. In this embodiment of the invention, some or all of the process gas from either the drying or preheat stages 42, 50, 34 of the grate 36 is transported by ducts 70 and a process gas blower 72 to the first section 20 of the cooler 12. The hot process air may be mixed with the cooler ambient air at or inside the cooler 12. Ideally, the process gas supplied to the cooler 12 should be the lowest temperature and lowest oxygen process gas available. The typical cooler area will probably have to be increased to compensate for the fact that the process gas will be hotter than ambient air, so will provide less cooling, but using the process gas in the hottest section 20 of the cooler 12 will help to mitigate this effect by maintaining the highest possible temperature difference between the product being cooled and the cooling media.

The reduced oxygen stream leaving the first section 20 of the cooler 12 may be then routed directly to the kiln 10 through the duct 24. The reduced oxygen content in the process gas stream will reduce the NOx in the process, even if none of the other steps or embodiments of the invention are incorporated, but this step may be most effective if combined with one or more of the further steps and embodiments described below.

Figure 2:
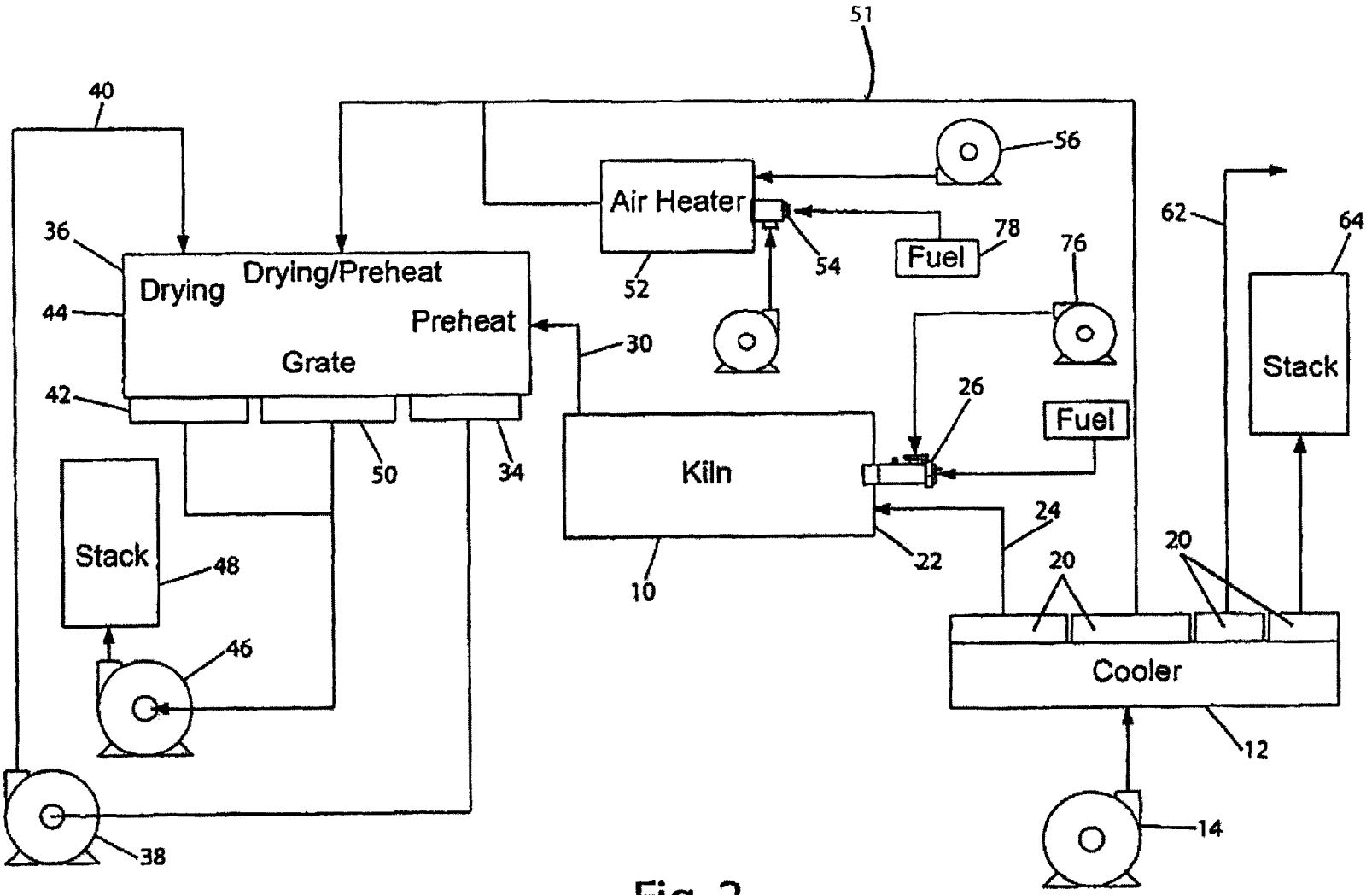
Fig. 2 Prior Art
Figure 5:
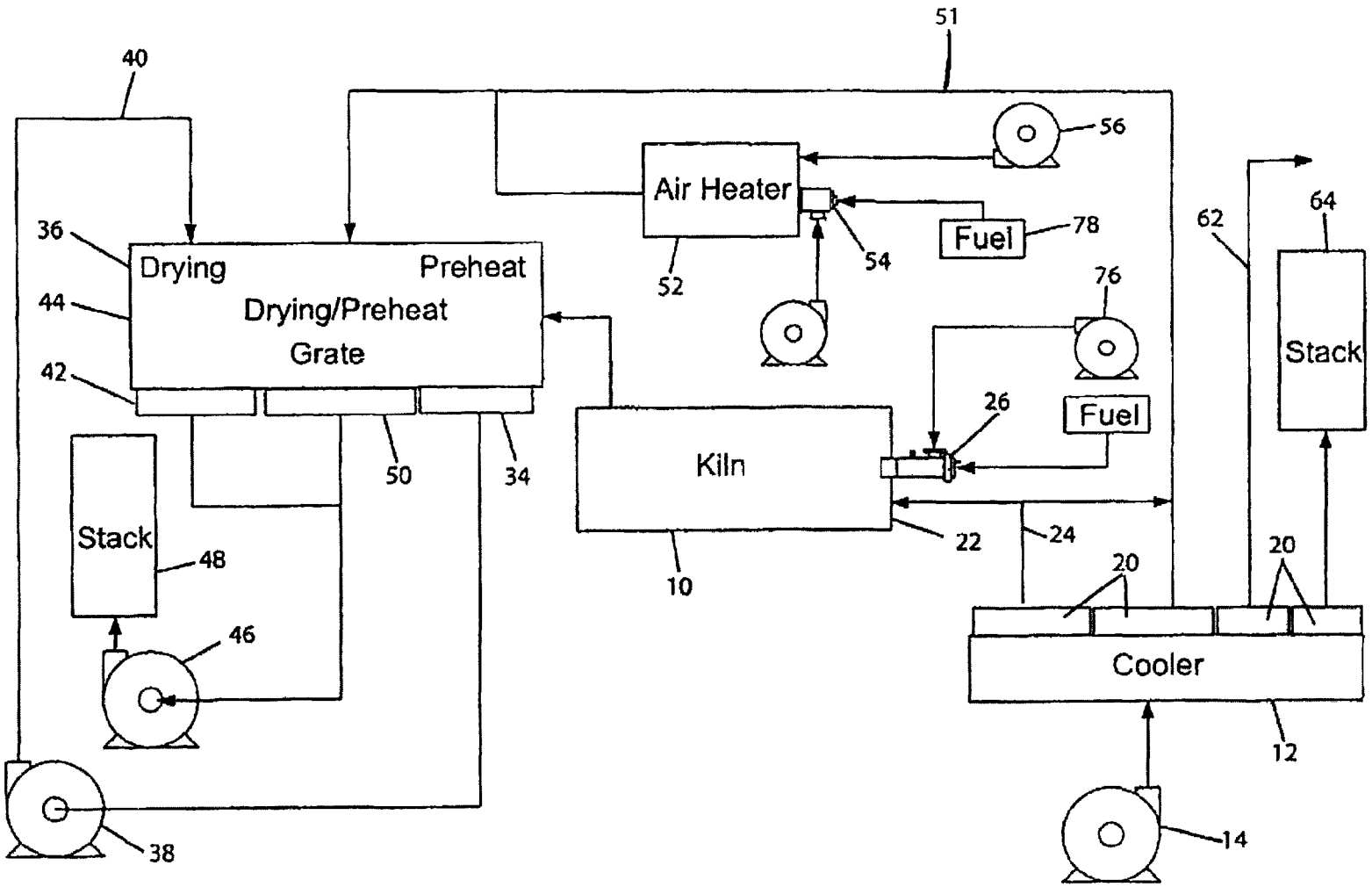

In the embodiment shown in FIG. 5, the duct structure 24 is configured to divert some of the high temperature oxidant from the first stage 20 of the cooler 12 to mix with the lower temperature oxidant going to the grate 36 through the duct 51, thus raising the temperature of the oxidant from (in the example shown) 1300 F to 1500 F—about the same temperature that is achieved by incorporating the air heater in the prior art of FIG. 2. Since less high temperature air is going to the kiln 10, the combustion air blower 76 supplying the kiln burner 26 may now be configured to supply additional ambient air, replacing the high temperature air that is being diverted to the grate. This will result in lower NOx in the kiln 10 in potentially two ways. First, just maintaining the same total air mass flow into the kiln 10 at a lower air temperature will reduce the kiln NOx, and second, using increased air supply to the kiln burner 26 will allow replacement of the typical sub-stoichiometric kiln burner with any one of a number of types of Low-NOx burners. If enough air is diverted, a lean-premix type Low NOx burner can be used on the kiln 10, which will result in much lower NOx emissions.

Diverting the high temperature air to the grate 36 allows several other options which will maintain the efficiency benefits from using the high temperature air in the process. One option (not shown) is that the air heater 52, and thus the fuel input 78 to the burner 54 at the air heater 52, can be eliminated while still maintaining the same air and heat input to the grate 36. This will compensate for the extra fuel that will have to be used by the kiln burner 26 because of using lower temperature air in the kiln 10. Another option is to keep the air heater 52 as shown in FIG. 5, but not to fire the burner 54 on it during normal operation. This option keeps the air heater 52 and its burner 54 available for operation under special conditions, such as during start-up, when it is useful to have to help bring the process on-line. A third option is that the air heater 52 and its burner 54 can be used in conjunction with the higher temperature input stream to increase the total energy input to the grate 36. This will allow less energy to be input by the kiln burner 26, which will make the process more efficient and also reduce NOx. This option reduces NOx further because the kiln burner 26 is the source of most of the NOx generated by the process, and generates NOx at a level much higher than the air heater burner 54, because of the higher operating temperature in the kiln 10.

Figure 6:
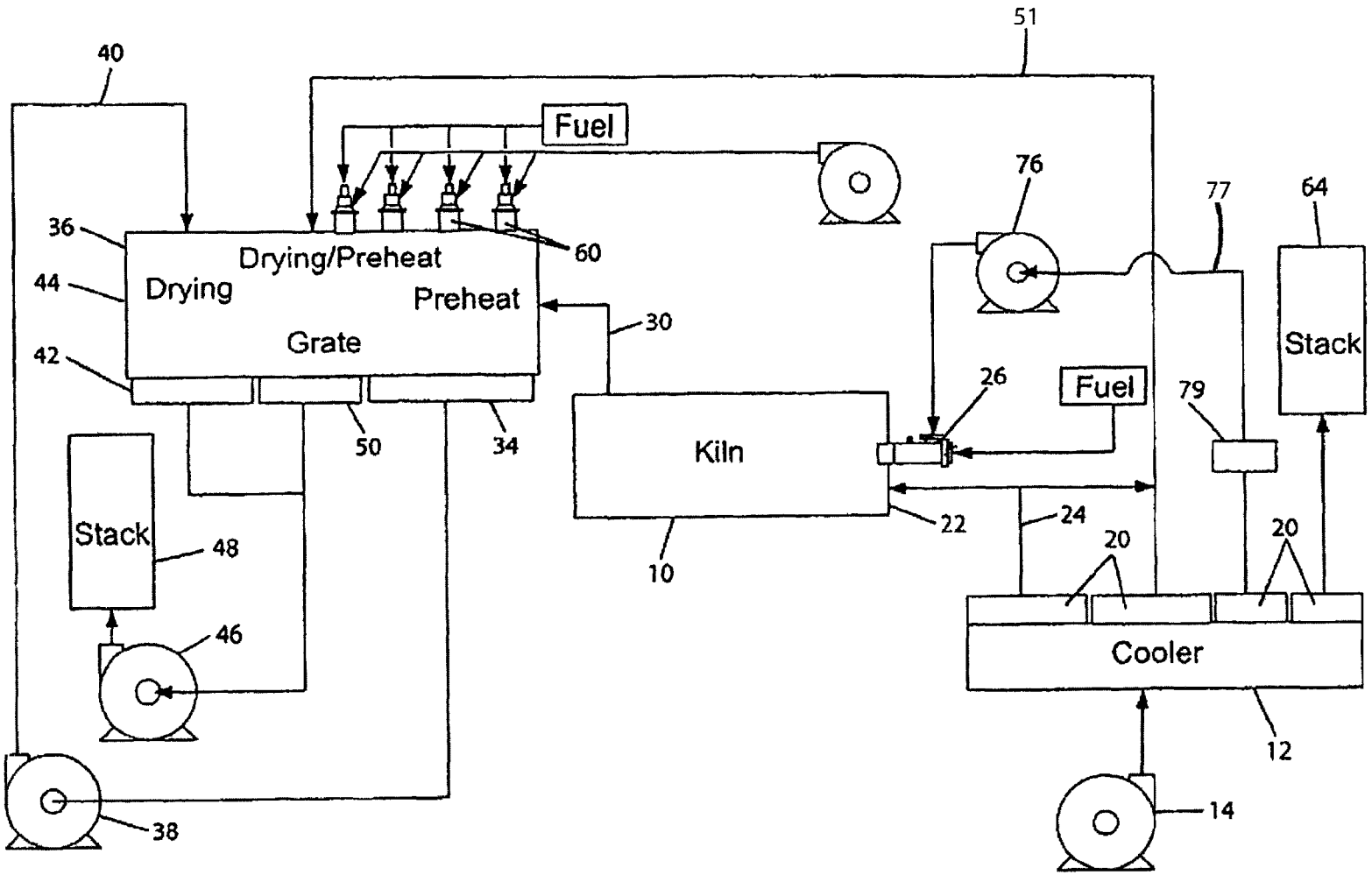

A slightly different embodiment is illustrated by FIG. 6, which shows the invention applied to the prior art of FIG. 3. In this case, the additional heat input to the grate 36 achieved by diverting the high temperature cooler air as described above is used to replace or augment the heat provided from preheat burners 60. The same options and benefits apply to the preheat burners 60 as described with respect to the air heater 52 in FIG. 5. This feature of the invention can also be applied to configurations that combine both preheat burners and an air heater (not shown).

FIG. 6 also shows an additional feature of the invention which may be implemented independently or in combination with others. The kiln burner 26 and kiln burner combustion air blower 76 are supplied with air at approximately 800 F from a duct 77 that draws from an intermediate section 20 of the cooler. This embodiment preferably includes a filter 79 or other means for cleaning the gas before it enters the blower 76. Up to a temperature of about 900 F, this air can also be used as combustion air for a lean premix type burner. Since the lean premix burner produces very low NOx emissions, the heat in this air can be used in the process, helping to keep the efficiency high while still providing very low NOx emissions. If used as shown in FIG. 6, depending on the range of possible air temperatures from the cooler 12, the supply to the combustion air blower 76 may require a dilution air source and temperature control loop (not shown), such as are known in the art, to protect the combustion air blower 76 from damage which might be caused by excessive temperature, and to prevent flashback from occurring if a lean premix burner is used for the kiln burner 26.

Figure 7:
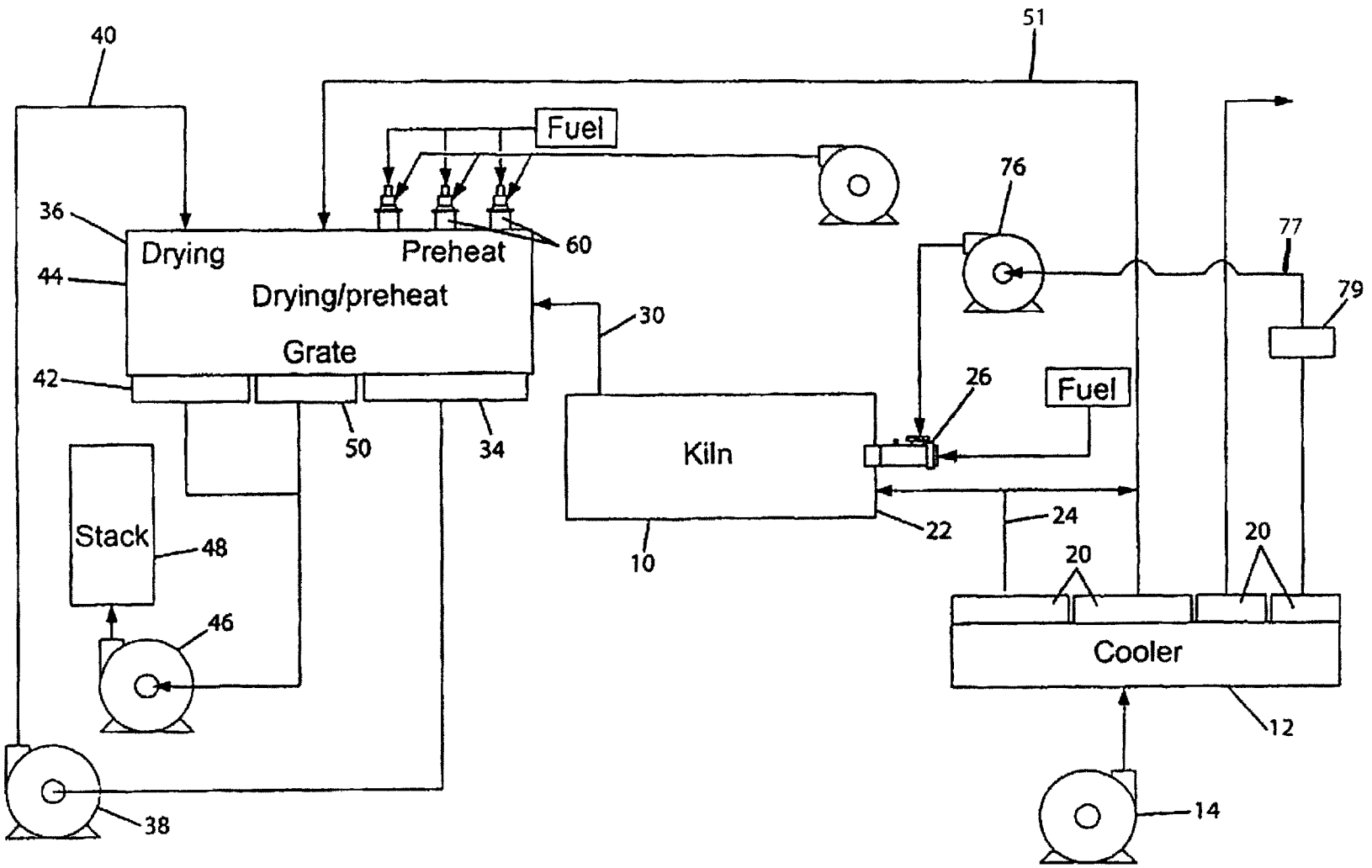

FIG. 7 shows an alternative feature that may be incorporated if it is desired to use the 800 F air from the intermediate section 20 of the cooler 12 in another part of the plant. In this step, the air from the final, coolest section 20 of the cooler 12, which is at perhaps 300 F, is used as combustion air to supply the combustion air blower 76 for the kiln burner 26.

Figure 8:
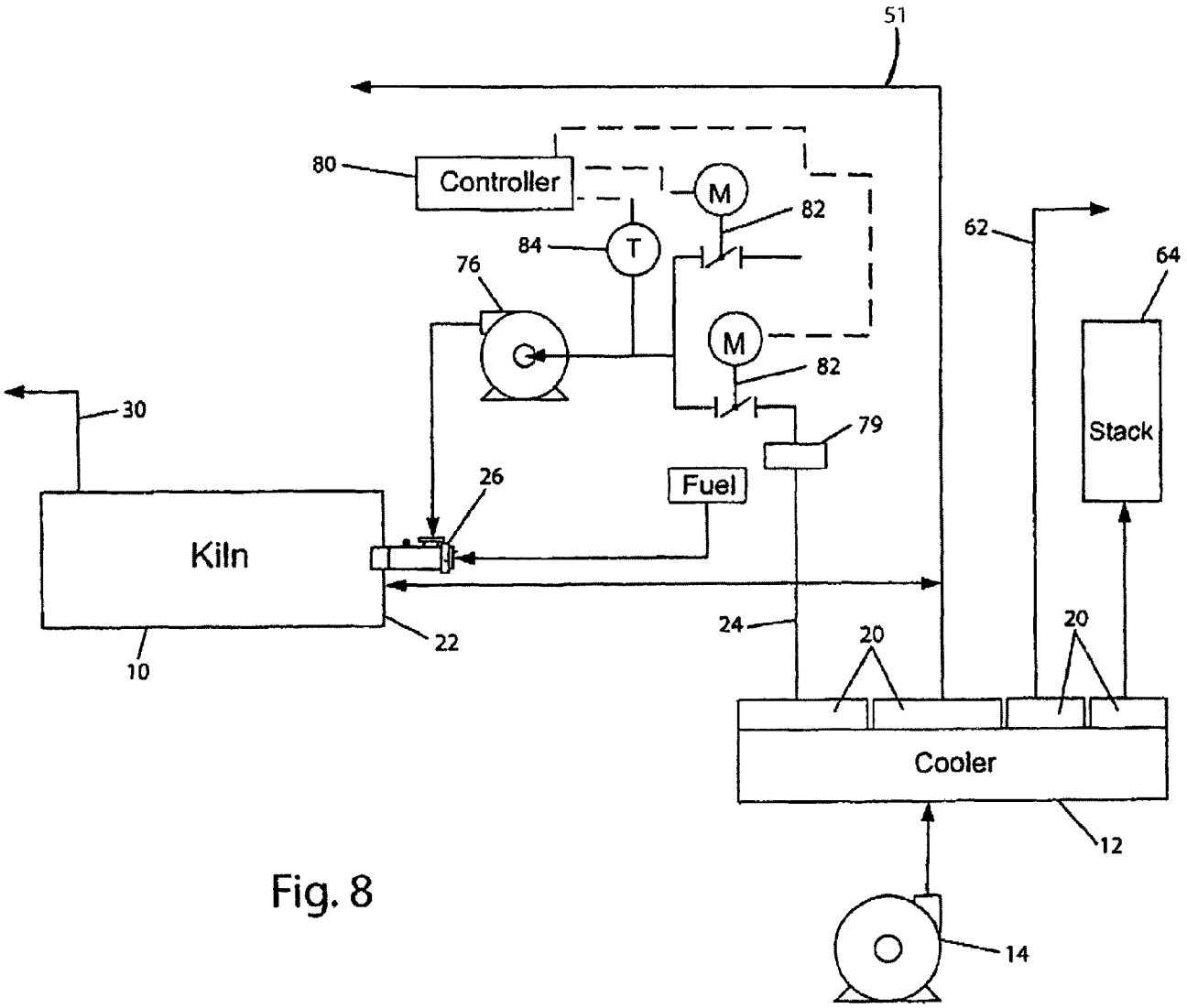

FIG. 8 shows part of the process in greater detail than the previous figures, in order to illustrate another feature of the invention. As shown in FIG. 8, part of the high temperature air that went to the kiln 10 in the prior art configurations is diverted to combine with the air from the intermediate stage 20 of the cooler 12 in order to increase the temperature of the air supplied to the grate 36, as in the embodiments of FIGS. 5, 6 and 7. FIG. 8 also illustrates the additional step of diverting part of the high temperature air from the high temperature stage 20 of the cooler 12 to mix with ambient air to create a combined 800 F degree stream of combustion air supplied to the combustion air blower 76 and kiln burner 26. If there are practical limits due to retrofit or other constraints that prevent diverting all of the available high temperature air to the grate 36, this feature of the invention allows using more of this air in the kiln 10 while still using a lean premix burner for the kiln burner 26, which will provide very low NOx emissions and increased efficiency compared to being required to reject this high temperature air to atmosphere without using the energy contained in it.

A controller 80 operates flow control devices 82 in response to one or more temperature sensors 84 to limit the air temperature to the combustion air blower 76 to a safe level; such as 800 F for example, but the actual temperature will depend on the specific process and equipment selected for a particular installation.

Figure 9:
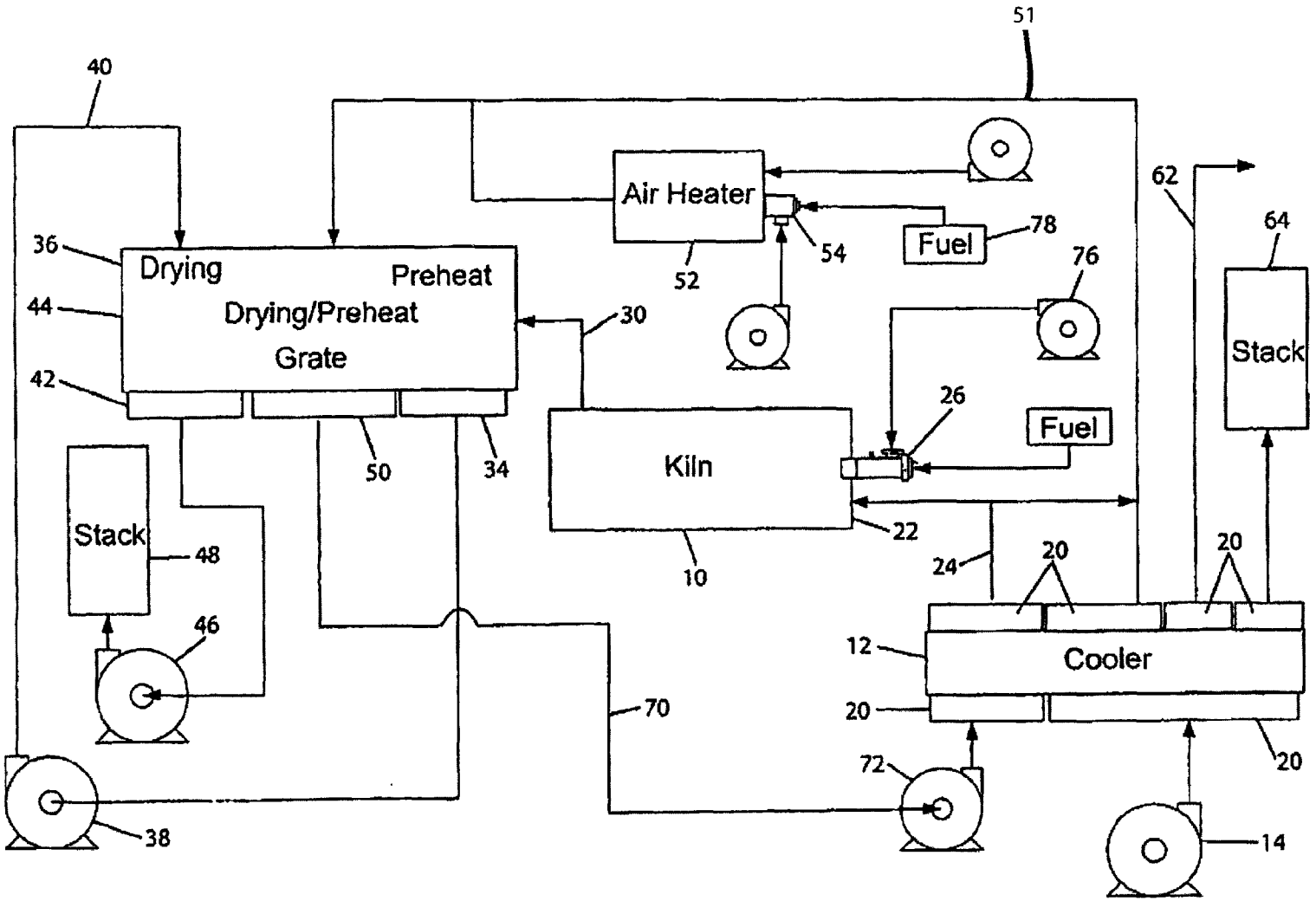

FIG. 9 shows an embodiment in which the feature of the invention described above with reference to FIG. 4, i.e. supplying the hottest section 20 of the cooler 12 with process exhaust gas via a process exhaust blower 72 in lieu of ambient air from the cooling air blower 14, is combined with the diverting feature of FIG. 5.

Figure 10:
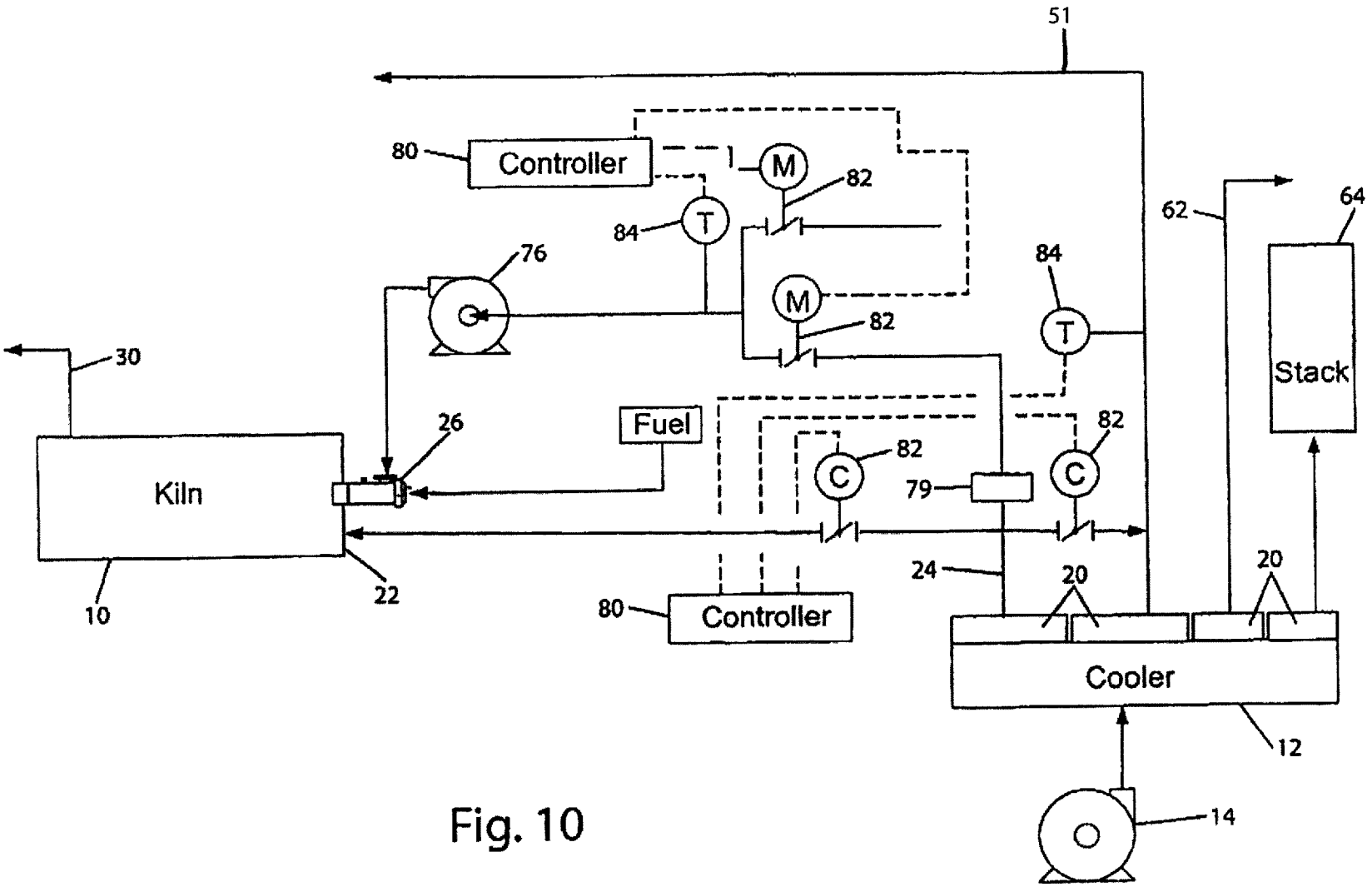

FIG. 10 shows an embodiment in which the high temperature (perhaps 2000 F) air stream from the hottest cooler section 20 is divided into two or three process streams; one stream going directly to the kiln 10; one stream going to mix with the intermediate stage cooler air to provide a higher temperature (1500 F) stream going to the grate 36, and one stream going to the kiln combustion air blower 76. As in FIG. 8, a flow control device 82, such as a damper and actuator, is installed in the high temperature stream and also in an ambient air stream. The controller 80 modulates the opening of the two control devices 82 to maintain a desired value read by a thermocouple or other temperature device 84.

Similarly, it may be desirable to control the amount of flow, or the mixed fluid temperature, or both, of the combined stream going to the grate section 36. As shown in FIG. 10, a flow control device 82 may be placed in each of the high temperature flow streams, and these devices 82 can be controlled by a controller 80 to maintain a desired temperature level. Since the fluid temperature is very high, flow control devices such as dampers can be expensive. The temperature or flow target can be maintained by other means known in the art as well, including: size or operating speed of process gas blowers, aspirators or educators, relative sizing of ducts or flow restrictions, appropriate baffle placement within the cooler 12 or cooler cover.

Figure 11:
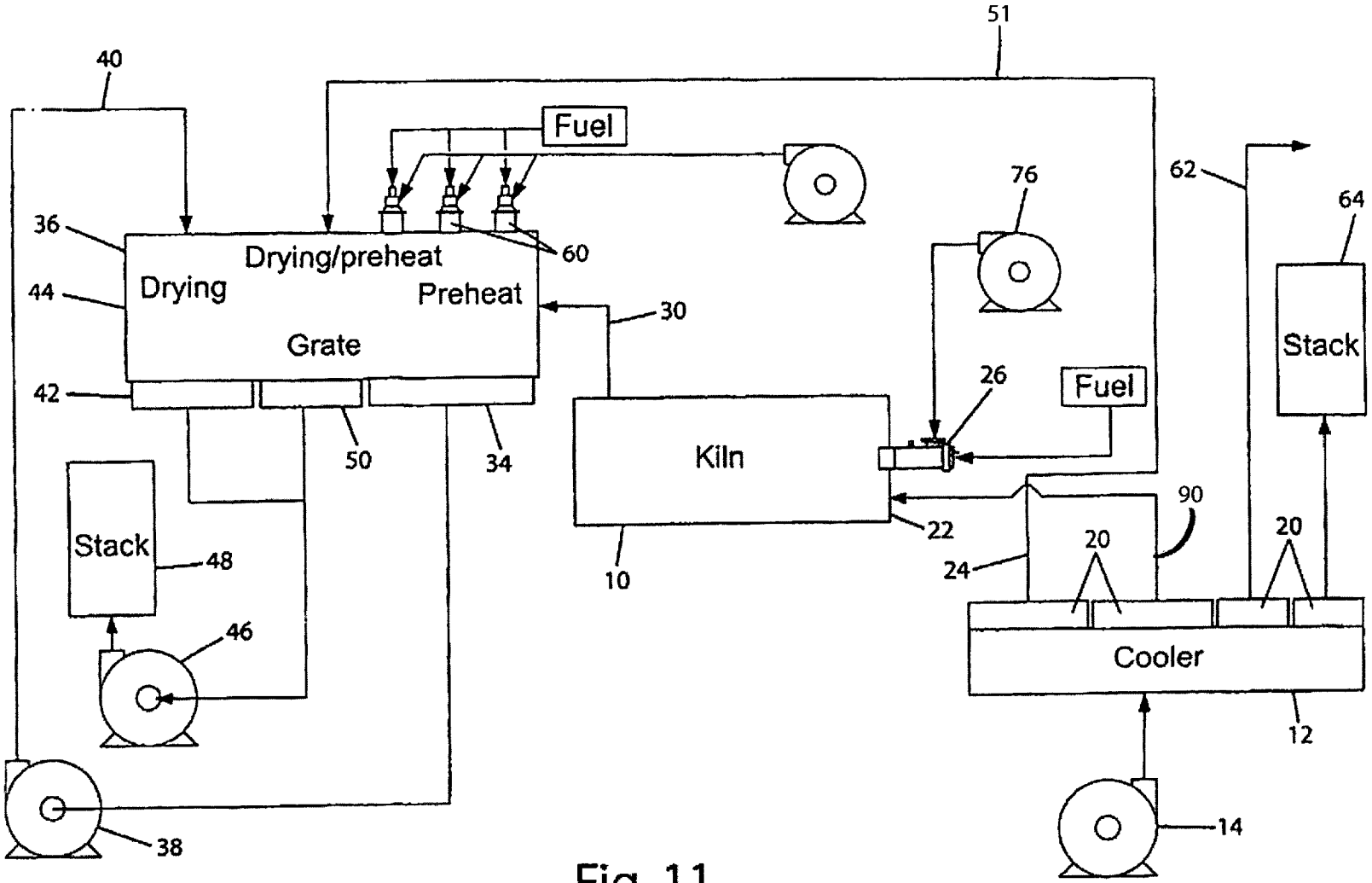

FIG. 11 shows an embodiment that re-routes some or all of the highest temperature air leaving the cooler 12 to the preheating and/or drying sections 34,42,50 of the grate 36, instead of directing it to the kiln 10. Lower temperature air can be provided to the kiln 10 from an intermediate section 20 of the cooler 12 through a duct 90 as shown, or by replacing the higher temperature air that was re-routed, for example, by increasing the capacity of the combustion air blower 76 providing air to the kiln burner 26.

Accordingly, the problem of high NOx emissions can be solved by one or more of the following:

a. Vitiation of the high temperature air from the cooler by means of substituting process gas from the grate for ambient air as the source of cooling for the high temperature stage of the cooler.

b. Vitiation of the kiln burner combustion air by substituting vitiated process gas from the cooler as described above for part of the ambient combustion air provided to the kiln burner.

c. Reduction of the amount of high temperature air from the cooler that is provided to the kiln.

d. Increasing the fraction of heating done by the grate section and decreasing the heating done by the kiln.

e. Replacing hot air from the cooler with ambient or warm air provided to a Low NOx burner.

f. Replacing the sub-stoichiometric burner on the kiln with a Low NOx burner using stoichiometric or excess air.

The problem of decreasing efficiency from implementing Low NOx measures can be solved by a combination of one or more of:

a. Diverting the air from the high-temperature end of the cooler to the grate section instead of rejecting it.

b. Using air from the high, intermediate, or low temperature parts of the cooler as some or all of the kiln burner combustion air.

c. Increasing the fraction of heating done by the grate section and decreasing the heating done by the kiln.

The invention can thus reduce NOx emissions from kilns that operate at high temperatures while using high temperature air recuperated from coolers as combustion air and process air. The invention accomplishes the reduction of NOx emissions from high-temperature, high-excess air kiln furnaces with no fuel efficiency penalty, or with a smaller fuel-efficiency penalty, compared to the prior art.

Additionally, any of the various embodiments of the invention may be of retrofitted construction. For example, the prior art apparatus of FIG. 2 can be retrofitted to provide the embodiment of FIG. 5. This can be accomplished by configuring the duct structure 24 of FIG. 2 to divert preheated gas to the grate 36 as shown in FIG. 5. Importantly, for a given set of operating conditions, the prior art apparatus of FIG. 2 has a limited capacity to provide heat input to the grate 36 as a fraction of a total heat input provided to the grate 36 and the rotary kiln 10. Retrofitting the prior art apparatus by configuring it to divert preheated gas to the grate 36 would increase the capacity to provide heat input to the grate 10 as a fraction of the total heat input provided to the grate 36 and the rotary kiln 10. For a given total heat input under given operating conditions, the embodiment of FIG. 5 can thus provide an equally decreased fractional heat input at the rotary kiln 10 to yield less NOx from the rotary kiln 10.

As shown in FIG. 6, the grate 36 is equipped with four preheat burners 60, whereas the prior art apparatus of FIG. 3 is shown to have only three preheat burners 60 at the grate 36, and the prior art apparatus of FIG. 2 has no preheat burners at the grate 36. An increased fractional heat input capacity at the grate 36 can thus be obtained by installing one or more preheat burners 60, or by replacing an existing preheat burner 60 with a preheat burner 60 having a greater heat input capacity. This increase could be provided either with the gas diverting feature of the FIG. 5 duct structure 24, as shown in FIG. 6, or without that feature. Each of the embodiments shown in FIGS. 7-11, as well as any other embodiment of the invention, can also be provided by retrofitting a prior art apparatus as needed to provide the elements of the invention as shown, described and claimed.

This written description sets forth the best mode of carrying out the invention, and describes the invention so as to enable a person skilled in the art to make and use the invention, by presenting examples of elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they have equivalent elements with insubstantial differences from the literal language of the claims.

The invention claimed is:

1. An apparatus comprising:

a rotary kiln;

a grate that conveys pelletized material to the rotary kiln;

a cooler that cools pelletized material from the rotary kiln;

a gas flow apparatus that directs a stream of gas from the cooler to the grate along a flow path that bypasses the rotary kiln to transfer heat from pelletized material in the cooler to pelletized material on the grate;

a gas flow apparatus that directs a stream of gas from the cooler to the rotary kiln along a flow path that bypasses the grate to provide preheated combustion air for pelletized material in the rotary kiln; and a gas flow apparatus that directs a stream of gas from the grate to the cooler along a flow path that bypasses the rotary kiln to provide gas for vitiating the preheated combustion air, including a blower with an inlet and a discharge, and ducts that reach from the grate to the inlet and from the discharge to the cooler.

2. An apparatus as defined in claim 1 wherein the gas flow apparatus that directs a stream of gas from the cooler to the rotary kiln draws successively cooler streams of gas from respective sections of the cooler, including a hottest section, an intermediate section, and a coolest section, and the gas flow apparatus that directs a stream of gas from the grate to the cooler directs the stream of gas from the grate to flow into the hottest section of the cooler.

3. An apparatus comprising:

a rotary kiln having a discharge end;

a grate that conveys pelletized material to the rotary kiln;

a cooler that cools pelletized material from the rotary kiln; and a gas flow apparatus that a) draws successively cooler streams of gas from respective sections of the cooler, including a first stream from a first section and a second stream from a second section cooler than the first section, b) directs the first stream from the cooler to the grate along a flow path that bypasses the rotary kiln to transfer heat from pelletized material in the cooler to pelletized material on the grate, and c) directs the second stream from the cooler into the rotary kiln through the discharge end of the rotary kiln to provide preheated process air for pelletized material in the rotary kiln.

4. An apparatus as defined in claim 3 wherein the first stream is the hottest of the successively cooler streams.

5. An apparatus comprising:

a rotary kiln;

a grate that conveys pelletized material to the rotary kiln;

a cooler that cools pelletized material from the rotary kiln;

means for transferring heat from pelletized material in the cooler to pelletized material on the grate by directing a stream of gas from the cooler to the grate along a flow path that bypasses the rotary kiln;

means for providing preheated combustion air for pelletized material in the rotary kiln by directing a stream of gas from the cooler to the rotary kiln along a flow path that bypasses the grate; and means for vitiating the preheated combustion air by directing a stream of gas from the grate to the cooler along a flow path that bypasses the rotary kiln.

6. An apparatus as defined in claim 5 wherein the means for providing preheated combustion air for pelletized material in the rotary kiln draws successively cooler streams of gas from respective sections of the cooler, including a hottest section, an intermediate section, and a coolest section, and the means for vitiating the preheated combustion air directs the stream of gas from the grate to flow into the hottest section of the cooler.

* * * * *